US011149237B2

(12) United States Patent
Nad et al.

(10) Patent No.: US 11,149,237 B2
(45) Date of Patent: Oct. 19, 2021

(54) DETERGENT BARS

(71) Applicant: Dow Global Technologies LLC, Midland, MI (US)

(72) Inventors: Saugata Nad, Mumbai (IN); Ravi Rao, Pune (IN); Robert Krasnansky, Le Rouret (FR)

(73) Assignee: Dow Global Technologies LLC, Midland, MI (US)

( * ) Notice: Subject to any disclaimer, the term of this patent is extended or adjusted under 35 U.S.C. 154(b) by 209 days.

(21) Appl. No.: 16/335,295

(22) PCT Filed: Sep. 25, 2017

(86) PCT No.: PCT/US2017/053152
§ 371 (c)(1),
(2) Date: Mar. 21, 2019

(87) PCT Pub. No.: WO2018/063953
PCT Pub. Date: Apr. 5, 2018

(65) Prior Publication Data

US 2020/0017804 A1 Jan. 16, 2020

(30) Foreign Application Priority Data

Sep. 30, 2016 (IN) ..... 201611033456

(51) Int. Cl.

| | |
|---|---|
| ***C11D 17/00*** | (2006.01) |
| ***C11D 3/22*** | (2006.01) |
| ***C11D 3/37*** | (2006.01) |
| ***C11D 11/00*** | (2006.01) |

(52) U.S. Cl.
CPC ..... *C11D 17/0065* (2013.01); *C11D 3/225* (2013.01); *C11D 3/3707* (2013.01); *C11D 3/3761* (2013.01); *C11D 11/0017* (2013.01); *C11D 11/0023* (2013.01)

(58) Field of Classification Search
CPC ..... C11D 17/0065; C11D 3/225; C11D 3/07; C11D 3/3761; C11D 11/0017; C11D 11/0023
See application file for complete search history.

(56) References Cited

U.S. PATENT DOCUMENTS

| | | | | |
|---|---|---|---|---|
| 3,178,370 | A | 4/1965 | Okenfuss | |
| 3,706,672 | A | 12/1972 | Martin et al. | |
| 5,520,840 | A | 5/1996 | Massaro et al. | |
| 5,759,982 | A | 6/1998 | Wise et al. | |
| 6,248,703 | B1 * | 6/2001 | Finucane | C11D 1/126 510/152 |
| 7,662,761 | B2 * | 2/2010 | Subramanian | C11D 9/002 510/141 |
| 7,981,852 | B2 | 7/2011 | Yang et al. | |
| 8,906,839 | B2 | 12/2014 | Lentsch et al. | |
| 10,196,592 | B2 * | 2/2019 | Pham | C11D 3/08 |
| 2004/0077514 | A1 * | 4/2004 | Price | C11D 3/3723 510/311 |
| 2006/0270572 | A1 * | 11/2006 | Subramanian | C11D 17/006 510/141 |
| 2007/0212323 | A1 | 9/2007 | Polonka et al. | |
| 2011/0183881 | A1 | 7/2011 | Delos Reyes | |
| 2014/0053508 | A1 * | 2/2014 | Chourey | C11D 9/265 53/432 |

FOREIGN PATENT DOCUMENTS

| | | | |
|---|---|---|---|
| CN | 1250085 | A | 4/2000 |
| CN | 101513415 | A | 8/2009 |
| EP | 819165 | B1 | 9/1999 |
| EP | 1351665 | A1 | 10/2003 |
| GB | 2222410 | A | 3/1990 |
| JP | 2006063099 | A | 3/2006 |

* cited by examiner

*Primary Examiner* — Necholus Ogden, Jr.
(74) *Attorney, Agent, or Firm* — Kenneth Crimaldi

(57) ABSTRACT

A detergent bar comprising from 0.01 to 1 wt % polyethylene glycol having a molecular weight of at least 100,000 and at least one of:
(a) from 0.01 to 5 wt % polyacrylic acid having a molecular weight from 1,000 to 20,000; (b) from 0.01 to 1 wt % hydroxypropyl methylcellulose; and (c) from 0.01 to 1 wt % hydroxyethyl cellulose.

18 Claims, No Drawings

DETERGENT BARS

This invention relates to a detergent bar having improved properties.

Surfactant-containing bars are used for hand dishwashing or hand laundry. Structural integrity of the bars on prolonged exposure to water is a known problem. The bars are susceptible to swelling and increased wear, along with "mushiness." Addition of cellulose at amounts in excess of 1% has been proposed as a solution to this problem, as in, e.g., GB2222410. However, cellulose does not significantly improve structural integrity, even at fairly high levels.

The problem solved by this invention is the need for detergent bars having improved physical properties.

STATEMENT OF INVENTION

The present invention provides a detergent bar comprising from 0.01 to 1 wt % polyethylene glycol having a molecular weight of at least 100,000 and at least one of: (a) from 0.01 to 5 wt % polyacrylic acid having a molecular weight from 1,000 to 20,000; (b) from 0.01 to 1 wt % hydroxypropyl methylcellulose; and (c) from 0.01 to 1 wt % hydroxyethyl cellulose.

The present invention further provides a detergent bar comprising from 0.01 to 5 wt % polyacrylic acid having a molecular weight from 1,000 to 20,000 and at least one of: (a) from 0.01 to 1 wt % hydroxypropyl methylcellulose; and (b) from 0.01 to 1 wt % hydroxyethyl cellulose.

The present invention further provides a detergent bar comprising from 0.01 to 1 wt % hydroxypropyl methylcellulose and from 0.01 to 1 wt % hydroxyethyl cellulose.

DETAILED DESCRIPTION

Percentages are weight percentages (wt.%) and temperatures are in ° C., unless specified otherwise. Operations were performed at room temperature (20-25° C.), unless specified otherwise. Percentages of detergent bar components are based on the entire weight of the bar. A "gel" is a mixture of ingredients which will spontaneously form a gel or the formed gel.

Preferably, the polyethylene glycol has a molecular weight ($M_n$) of at least 300,000, preferably at least 500,000, preferably at least 1,000,000, preferably at least 2,000,000, preferably at least 3,000,000; preferably no more than 10,000,000, preferably no more than 8,000,000, preferably no more than 7,000,000. Preferably, the detergent bar comprises at least 0.05 wt % of the polyethylene glycol, preferably at least 0.07 wt %, preferably at least 0.09 wt %, preferably at least 0.12 wt %; preferably no more than 0.8 wt %, preferably no more than 0.6 wt %, preferably no more than 0.5 wt %.

Preferably, the polyacrylic acid has a molecular weight (Mw) of at least 1,500, preferably at least 2,000, preferably at least 2,500, preferably at least 3,000; preferably no more than 15,000, preferably no more than 10,000, preferably no more than 7,000, preferably no more than 6,000. Preferably, the detergent bar comprises at least 0.2 wt % of the polyacrylic acid, preferably at least 0.4 wt %, preferably at least 0.6 wt; preferably no more than 4.5 wt %, preferably no more than 4 wt %, preferably no more than 3.5 wt %, preferably no more than 3 wt %.

In the hydroxypropyl methylcellulose ethers (HPMC), preferably the alkyl ether groups are 2-hydroxypropyl. A specific example of HPMC polymers is METHOCEL HPMC, commercially available from The Dow Chemical Company. The number of methyl ether or hydroxypropyl groups per glucopyranosyl unit is determined by analysis of the polymer. For example, for METHOCEL HPMC polymers the determination of the % methoxyl and % hydroxypropoxyl in hydroxypropyl methylcellulose is carried out according to the United States Pharmacopeia (USP 32). The values obtained are % methoxyl and % hydroxypropoxyl. These are subsequently converted into degree of substitution (DS) for methyl substituents and molar substitution (MS) for hydroxypropyl substituents. Residual amounts of salt and moisture have been taken into account in the conversion. The preferred % methoxyl varies between 10% and 35%, and the preferred % hydroxypropoxyl varies between 0 and 40%. For hydroxyethyl cellulose, e.g., CELLOSIZE HEC polymers, the determination of the ethylene oxide molar substitution (EO MS) can be conducted using the Zeisel method as described in ASTM D-4794. The preferred EO MS varies between 0.5 and 5.0, preferably 1.5 to 3.5, preferably 1.5 to 2.5.

Preferably, an alkyl cellulose ether or a hydroxyalkyl cellulose ether has an average degree of substitution of 1.0 to 2.5 alkyl ether groups per glucopyranosyl unit; preferably it has a viscosity, measured from a 1 wt % solution in water at 20° C., of 10 to 100,000 mPa·s, preferably 50 to 7,000, preferably 100 to 6,000. Aqueous solution viscosities were measured for these cellulose ethers using either a Brookfield LVT viscometer at 25° C. and 30 rpm or according to United States Pharmacopeia (USP 35, "Hypromellose", pages 3467-3469) followed by an Ubbelohde viscosity measurement according to DIN 51562-1:1999-01 (January 1999). Viscosities of cellulose ethers have been correlated with molecular weights, and accordingly, one skilled in the art would understand the meaning of either measurement. See C. M. Keary, *Carbohydrate Polymers,* vol. 45 (2001), pages 293-303. Cellulose polymers contain repeat units having a 1,4'-β-glucopyranosyl structure, also known as anhydroglucose.

Preferably, the alkyl or hydroxyalkyl cellulose ether is of formula (I)

I

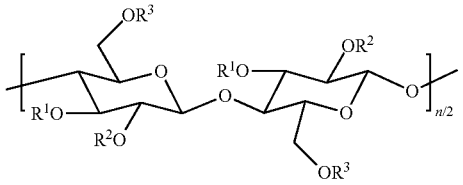

wherein $R^1$, $R^2$ and $R^3$ are independently selected from: hydrogen, alkyl or hydroxyalkyl; wherein alkyl groups may comprise from one to six carbon atoms which may be unsubstituted or substituted with carboxylic acid or salts thereof (attached to alkyl via carbon, e.g., carboxymethyl cellulose), halo or alkoxy; and n (also known as the "degree of polymerization") is from 25 to 7,500. Preferably, alkyl groups are unsubstituted. Preferably, n is from 2000 to 7,000, preferably 3,000 to 6,500. Preferably, the modified carbohydrate polymer has a weight-average molecular weight of at least 700,000, preferably at least 800,000, preferably no greater than 2,500,000, preferably no greater than 2,000,000.

Preferably, the detergent bar is substantially free of any cellulose derivative other than HPMC or HEC, i.e., the total amount of other cellulose derivatives is no greater than 2 wt %, preferably no greater than 1 wt %, preferably no greater than 0.5 wt %, preferably no greater than 0.2 wt %. Preferably, the detergent bar comprises no more than 5 wt % cellulose, preferably no more than 3 wt %, preferably no more than 1 wt %, preferably no more than 0.5 wt %.

Preferably, the detergent bar comprises at least 0.05 wt % of HPMC, preferably at least 0.07 wt %, preferably at least 0.09 wt %, preferably at least 0.12 wt %; preferably no more than 0.8 wt %, preferably no more than 0.6 wt %, preferably no more than 0.5 wt %. Preferably, the detergent bar comprises at least 0.1 wt % of HEC, preferably at least 0.15 wt %, preferably at least 0.2 wt %, preferably at least 0.3 wt %; preferably no more than 0.9 wt %, preferably no more than 0.8 wt %, preferably no more than 0.7 wt %.

Preferably, the detergent bar comprises from 5 to 25 wt % surfactants; preferably at least 7 wt %, preferably at least 9 wt %, preferably at least 11 wt %; preferably no more than 20 wt %, preferably no more than 17 wt %. Preferably, the surfactants are anionic surfactants. Linear alkylbenzene sulfonates (LABS) are preferred. Preferably, the detergent bar comprises from 75 to 95 wt % minerals; preferably at least 80 wt %, preferably at least 83 wt %; preferably no more than 93 wt %, preferably no more than 91 wt %, preferably no more than 89 wt %. Minerals include metal salts of inorganic anions, e.g., carbonate, silicate, sulfate and bicarbonate, as well as various types of clay. Preferably, the detergent bar comprises from 45 to 75 wt % of a mixture of dolomite and calcite; preferably from 50 to 70 wt %, preferably from 54 to 66 wt %. Preferably, the detergent bar comprises from 4 to 20 wt % of clay (preferably China clay), preferably from 6 to 18 wt %, preferably from 8 to 16 wt %. Preferably, the detergent bar comprises from 3 to 18 wt % of soda ash, preferably from 5 to 15 wt %, preferably from 6 to 14 wt %. The detergent bar may contain smaller amounts of other ingredients, e.g., sodium silicate, magnesium sulfate, perfume and coloring.

EXAMPLES

Composition of Examples 1-8

| Examples | STPP | PEG 8000 | Cellulose | PEO | HPMC | HEC | pAA |
|---|---|---|---|---|---|---|---|
| 1a | 0 | 0 | 0 | 0 | 0 | 0 | 0 |
| 1b | 3 | 0 | 0 | 0 | 0 | 0 | 0 |
| 1c | 0 | 2 | 0 | 0 | 0 | 0 | 0 |
| 1d | 0 | 0 | 0 | 0.2 | 0.1 | 0 | 0 |
| 2a | 0 | 0 | 0 | 0 | 0 | 0 | 0 |
| 2b | 3 | 0 | 0 | 0 | 0 | 0 | 0 |
| 2c | 0 | 5 | 0 | 0 | 0 | 0 | 1 |
| 2d | 0 | 0 | 0 | 0.2 | 0.1 | 0.6 | 1 |
| 2e | 0 | 0 | 0 | 0.2 | 0 | 0.6 | 1 |
| 3a | 0 | 0 | 0 | 0 | 0 | 0 | 0 |
| 3b | 3 | 0 | 0 | 0 | 0 | 0 | 0 |
| 3c | 0 | 0 | 0 | 0.2 | 0 | 0 | 1 |
| 4a | 0 | 0 | 0 | 0 | 0 | 0 | 0 |
| 4b | 3 | 0 | 0 | 0 | 0 | 0 | 0 |
| 4c | 0 | 0 | 0 | 0 | 0 | 0 | 0 |
| 4d | 0 | 0 | 0 | 0 | 0 | 0 | 1 |
| 4e | 0 | 0 | 0 | 0.2 | 0 | 0.6 | 1 |
| 5a | 0 | 0 | 0 | 0 | 0 | 0 | 0 |
| 5b | 3 | 0 | 0 | 0 | 0 | 0 | 0 |
| 5c | 0 | 0 | 0 | 0.2 | 0.2 | 0.6 | 1 |
| 6a | 0 | 0 | 0 | 0 | 0 | 0 | 0 |
| 6b | 0.3 | 0 | 0 | 0 | 0 | 0 | 0 |
| 6c | 0 | 0 | 0 | 0.1 | 0.2 | 0 | 0 |
| 6d | 0 | 0 | 0 | 0.1 | 0 | 0.6 | 0 |
| 6e | 0 | 0 | 0 | 0.1 | 0 | 0 | 1 |
| 6f | 0 | 0 | 0 | 0 | 0.2 | 0 | 1 |
| 6g | 0 | 0 | 0 | 0.1 | 0.2 | 0 | 1 |
| 6h | 0 | 0 | 0 | 0.2 | 0 | 0.6 | 1 |
| 7a | 0 | 0 | 0 | 0 | 0 | 0 | 0 |

-continued

| Examples | STPP | PEG 8000 | Cellulose | PEO | HPMC | HEC | pAA |
|---|---|---|---|---|---|---|---|
| 7b | 0.3 | 0 | 0 | 0 | 0 | 0 | 0 |
| 7c | 0 | 0 | 0 | 0 | 0.2 | 0.6 | 0 |
| 7d | 0 | 0 | 0 | 0.2 | 0 | 0.6 | 0 |
| 7e | 0 | 0 | 0 | 0 | 0 | 0.6 | 1 |
| 7f | 0 | 0 | 0 | 0 | 0 | 0 | 1 |
| 7g | 0 | 0 | 0 | 0 | 0.2 | 0 | 0 |
| 7h | 0 | 0 | 0 | 0.1 | 0 | 0 | 0 |
| 7i | 0 | 0 | 0 | 0 | 0 | 0.6 | 0 |
| 8a | 0 | 0 | 0 | 0 | 0 | 0 | 0 |
| 8b | 3 | 0 | 0 | 0 | 0 | 0 | 0 |
| 8c | 21 | 0 | 5 | 0 | 0 | 0 | 0 |
| 8d | 0 | 0 | 0 | 0.2 | 0 | 0.6 | 1 |

Inventive Examples are those having at least two ingredients to the right of the double line.

All Examples were based on the following bar formulation:

| | |
|---|---|
| LABS | 14 |
| Soda ash | 10 |
| Sodium silicate | 3.87 |
| Calcite | 29.5-29.7 |
| China Clay | 12.1 |
| $MgSO_4$ | 1.98 |
| Tinopal CBSX | 0.05 |
| Color | 0.06 |
| Perfume | 0.15 |
| Dolomite | q.s. to 100 |

Tinopal CBSX=Benzenesulfonic acid, 2,2'-([1,1'-biphenyl]-4,4'-diyldi-2,1-ethenediyl)bis-, disodium salt (optical brightener)

STPP=sodium tripolyphosphate, pAA=poly(acrylic acid), $M_w$ ca. 4500;

HPMC=hydroxypropyl methylcellulose, % methoxyl between 15% and 30%, % hydroxypropoxyl between 10 and 30%, Mw=800,000; HEC=hydroxyethyl cellulose, degree of subs. ca. 2, $M_w$=1,000,000; PEO=polyethylene oxide, $M_n$=5,000,000

Mush is the percent weight loss on exposure to water at room temperature; Rate of wear is the percent weight loss after 6 hours use; AD release is the amount of active material dissolved in water at room temperature Results from testing were as follows:

| | Properties | | | | |
|---|---|---|---|---|---|
| Examples | Integrity Mush, % | Wear, % | AD rel | Sensorial Skin | Foam |
| 1a | 17 | 15 | 3.5 | 1 | 2 |
| 1b | 15 | 13 | 3.1 | 2 | 3 |
| 1c | 15 | 11 | 3.2 | 2 | 3 |
| 1d | 9 | 7 | 1.5 | 5 | 5 |
| 2a | 17 | 15 | 3.5 | 1 | 2 |
| 2b | 15 | 13 | 3.1 | 2 | 3 |
| 2c | 16 | 12 | 2.8 | 2 | 2 |
| 2d | 9 | 7 | 1.5 | 5 | 5 |
| 2e | 10 | 7 | 1.64 | 5 | 4 |
| 3a | 17 | 15 | 3.5 | 1 | 2 |
| 3b | 15 | 13 | 3.1 | 2 | 3 |
| 3c | 9.5 | 7.8 | 1.75 | 4 | 4 |
| 4a | 17 | 15 | 3.5 | 1 | 2 |
| 4b | 15 | 13 | 3.1 | 2 | 3 |
| 4c | 16 | 14 | 3.4 | 2 | 2 |
| 4d | 15 | 13.5 | 3.05 | 2 | 2 |
| 4e | 8.3 | 7.2 | 1.75 | 5 | 5 |
| 5a | 17 | 15 | 3.5 | 1 | 2 |

-continued

| Examples | Properties | | | | |
|---|---|---|---|---|---|
| | Integrity Mush, % | Wear, % | AD rel | Sensorial Skin | Foam |
| 5b | 15 | 13 | 3.1 | 2 | 3 |
| 5c | 7.8 | 7.2 | 1.75 | 5 | 5 |
| 6a | 17 | 15 | 3.5 | 1 | 2 |
| 6b | 15 | 13 | 3.1 | 2 | 3 |
| 6c | 8.6 | 7.1 | 1.9 | 5 | 5 |
| 6d | 8.9 | 7.5 | 1.8 | 5 | 5 |
| 6e | 8.2 | 7.7 | 1.6 | 4 | 4 |
| 6f | 9.1 | 7.6 | 1.82 | 4 | 4 |
| 6g | 8.5 | 7.1 | 1.75 | 5 | 5 |
| 6h | 8.3 | 7.2 | 1.75 | 5 | 5 |
| 7a | 17 | 15 | 3.5 | 1 | 2 |
| 7b | 15 | 13 | 3.1 | 2 | 3 |
| 7c | 8.5 | 7.1 | 1.9 | 5 | 5 |
| 7d | 8.7 | 7.5 | 1.8 | 5 | 5 |
| 7e | 8.2 | 7.7 | 1.6 | 4 | 4 |
| 7f | 9.4 | 7.6 | 1.82 | 4 | 4 |
| 7g | 8.5 | 7.1 | 1.75 | 5 | 5 |
| 7h | 8.3 | 7.2 | 1.75 | 5 | 5 |
| 7i | 8.8 | 7.5 | 1.76 | 4 | 5 |
| 8a | 17 | 15 | 3.5 | 1 | 2 |
| 8b | 15 | 13 | 3.3 | 2 | 3 |
| 8c | 11 | 10 | 2.5 | 4 | 4 |
| 8d | 9 | 6 | 1.5 | 5 | 5 |

Further samples were prepared using the following "blank" bar formulation:

| | |
|---|---|
| LABS | 14 |
| Sodium carbonate | 10 |
| Sodium Silicate | 3.87 |
| Calcite | 29.7 |
| China Clay | 12.1 |
| Magnesium Sulfate | 1.98 |
| STPP | 0 |
| HPMC | 0 |
| PEO | 0 |
| pAA | 0 |
| HEC | 0 |
| TINOPAL CBSX | 0.05 |
| Color | 0.06 |
| Perfume | 0.15 |
| Dolomite | Balance |

Amounts of added STPP, HPMC, PEO, pAA and HEC are listed in the table below along with the test results.

| Property | Blank | Blank + STPP, 6 wt % | Blank + HPMC, 0.2 wt % | Blank + PEO, 0.2 wt % | Blank + pAA, 3 wt % | Blank + HEC, 0.65 wt % | Blank + PEO, 0.2 wt % + pAA, 3 wt % | Blank + HEC, 0.65 wt % + pAA, 3 wt % | Blank + HPMC, 0.2 wt % + pAA, 3 wt % |
|---|---|---|---|---|---|---|---|---|---|
| Mush (wt % loss); | 17 | 15 | 9.5 | 8.2 | 8.5 | 9.7 | 6.3 | 7.1 | 7.1 |
| % Rate of wear, | 15 | 13 | 8.4 | 7.8 | 8.7 | 8.8 | 6.1 | 7.3 | 6.9 |
| AD release | 3.5 | 3.1 | 1.2 | 1.0 | 1.2 | 1.3 | 1.1 | 1.7 | 1.4 |

The invention claimed is:

1. A detergent bar comprising from 0.05 to 0.8 wt % polyethylene glycol having a molecular weight of at least 1,000,000 and at least one of:

(a) from 0.01 to 5 wt % polyacrylic acid having a molecular weight from 1,000 to 20,000;

(b) from 0.01 to 1 wt % hydroxypropyl methylcellulose; and (c) from 0.01 to 1 wt % hydroxyethyl cellulose.

2. The detergent bar of claim 1, wherein the polyethylene glycol has a molecular weight of at least 3,000,000 and no more than 8,000,000.

3. The detergent bar of claim 2, wherein the detergent bar comprises 0.4 to 4.5 wt % polyacrylic acid having $M_w$, from 1,500 to 15,000.

4. The detergent bar of claim 3, wherein the detergent bar comprises 0.05 to 0.6 wt % hydroxypropyl methylcellulose.

5. The detergent bar of claim 4, wherein the detergent bar comprises 0.15 to 0.9 wt % hydroxyethyl cellulose.

6. The detergent bar of claim 5 in which the hydroxypropyl methylcellulose has a methoxyl content between 15 and 30 wt % and a hydroxypropoxyl content between 10 and 30%; and the hydroxyethylcellulose has an ethylene oxide molar substitution from 0.5 to 5.

7. The detergent bar of claim 1, wherein the detergent bar contains no more than 1 wt % of any cellulose derivative other than hydroxypropyl methylcellulose and hydroxyethyl cellulose.

8. The detergent bar of claim 1, wherein the detergent bar contains 0.09 to 0.5 wt % of the polyethylene glycol.

9. A detergent bar comprising 5 to 24 wt % surfactant;

75 to 95 wt % minerals;

0.05 to 0.8 wt % polyethylene glycol having a molecular weight of 3,000,000 to 8,000,000;

0.4 to 4.5 wt % polyacrylic acid having a molecular weight of 1,500 to 15,000;

0.05 to 0.6 wt % hydroxypropyl methylcellulose; and 0.15 to 0.9 wt % hydroxyethyl cellulose.

10. The detergent bar of claim 9, wherein the surfactant is an anionic surfactant.

11. The detergent bar of claim 10, wherein the surfactant is linear alkylbenzene sulfonate.

12. The detergent bar of claim 9, wherein the detergent bar contains no more than 1 wt % of any cellulose derivative other than hydroxypropyl methylcellulose and hydroxyethyl cellulose.

13. The detergent bar of claim 12, wherein the hydroxypropyl methylcellulose has a methoxyl content of 15 and 30 wt % and a hydroxypropoxyl content of 10 and 30%; and the hydroxyethylcellulose has an ethylene oxide molar substitution of 0.5 to 5.

14. The detergent bar of claim 13, wherein the hydroxypropyl methyl cellulose has a weight average molecular weight of 700,000 to 2,500,000.

15. The detergent bar of claim 14, wherein the hydroxypropyl methyl cellulose has a weight average molecular weight of 800,000 to 2,500,000.

16. The detergent bar of claim 15, wherein the detergent bar contains 0.09 to 0.5 wt % of the polyethylene glycol.

17. The detergent bar of claim 9, wherein the minerals are selected from metal salts of carbonate, silicate, sulfate and bicarbonate; and clay.

18. The detergent bar of claim 9, wherein the minerals are selected from metal salts of carbonate, silicate, sulfate and bicarbonate.

* * * * *